US005703554A

United States Patent [19]

Polgar et al.

[11] Patent Number: 5,703,554

[45] Date of Patent: Dec. 30, 1997

[54] BISTABLE SWITCHING ARRANGEMENT

[75] Inventors: Tibor Polgar, Maria Enzersdor; Rudolf Mikl, Vienna, both of Austria

[73] Assignee: EH-Schrack Components Aktiengesellschaft, Vienna, Austria

[21] Appl. No.: 471,789

[22] Filed: Jun. 6, 1995

[30] Foreign Application Priority Data

Jun. 8, 1994 [AT] Austria ..... A 1149/94

[51] Int. Cl.[6] ..... H01F 7/00; H01F 7/08

[52] U.S. Cl. ..... 335/229; 335/281

[58] Field of Search ..... 335/229–234, 335/281

[56] References Cited

U.S. PATENT DOCUMENTS

| | | | |
|---|---|---|---|
| 2,295,390 | 9/1942 | Dicken . | |
| 2,749,454 | 6/1956 | Little et al. | 335/230 |
| 3,069,602 | 12/1962 | Stout . | |
| 3,160,796 | 12/1964 | Scheg . | |
| 3,470,510 | 9/1969 | Richert | 335/230 |
| 4,660,012 | 4/1987 | Bonniau et al. | 335/234 |
| 5,268,662 | 12/1993 | Uetsuhara et al. | 335/229 |

FOREIGN PATENT DOCUMENTS

| | | |
|---|---|---|
| 1 270 092 | 12/1961 | France . |
| 1 565 322 | 5/1969 | France . |
| 2 256 523 | 7/1975 | France . |
| 1 565 323 | 12/1996 | France . |
| 25 03 159 | 1/1976 | Germany . |
| 28 54 878 | 12/1978 | Germany . |
| 1 182 692 | 3/1970 | United Kingdom . |

*Primary Examiner*—Michael L. Gellner
*Assistant Examiner*—Raymond Barrera
*Attorney, Agent, or Firm*—Henry M. Feiereisen

[57] ABSTRACT

A bistable switching arrangement has a magnetic system comprised of a yoke/core, an armature and at least one permanent magnet, as well as a magnetic coil. The armature is swingably held at the core by a spring and mechanically linked to a movable contact, with an air gap being formed in one switching state between the armature and a pole face of the yoke/core combination. In order to attain that only slight forces act upon the released armature, the permanent magnet is positioned in a region of the yoke to form one part of the cross sectional area, with the other part being formed by a non-magnetic member.

8 Claims, 4 Drawing Sheets

BISTABLE SWITCHING ARRANGEMENT

BACKGROUND OF THE INVENTION

The present invention refers to a bistable switching arrangement and in particular to a switching arrangement of a type including a magnetic system having a core, optionally with a yoke, an armature operatively linked to a switching element, and at least one permanent magnet as well as a magnetic coil, whereby the armature is held by a spring in a switching state, and an air gap is formed in the switching state between the armature and a pole face of the core.

Switching arrangements of this type are generally provided in the area of the core or core/yoke combination with a permanent magnet which has a cross section matching the cross section of the core or of the yoke. Such a configuration is problematic because the permanent magnet applies a significant force upon the released armature, i.e. at a state when the useful air gap is great. Thus, the spring must be accordingly configured to exert a sufficient force in order to retain the armature securely in the released position and also to counter prevalent vibrations. This means that the permanent magnet must then apply correspondingly great attraction forces to overcome the spring force for moving the armature to the other stable state so that the magnetic system must contain strong coils that are wound on the core.

SUMMARY OF THE INVENTION

It is an object of the present invention to provide an improved switching arrangement obviating the afore-stated drawbacks.

In particular, it is an object of the present invention to provide an improved switching arrangement in which the permanent magnet exerts only slight attractive forces upon the released armature, and the energy required to move the armature between two stable switching states can be kept very low.

It is yet another object of the present invention to provide an improved switching arrangement in which the energy for moving the armature between the two stable switching states is concentrated within a very small space so as to permit a miniaturization of the switching arrangement.

It is still another object of the present invention to provide an improved switching arrangement which can be produced on an industrial scale at low production cost and in a time consuming manner while yet being highly reliable.

These objects and others which will become apparent hereinafter are attained in accordance with the present invention by placing a permanent magnet in at least one region of the magnetic system comprised of the yoke/core and the armature such that the permanent magnet forms only one part of a cross sectional area of the region.

Thus, in a magnetic sense, the permanent magnet is incorporated in the magnetic circuit in series to the coil that is wound on the core so that the attractive force exerted by the permanent magnet in the air gap of the magnetic system can be strengthened or weakened by the coil in dependence on its polarity. Since only part of the cross section is formed by the permanent magnet, a leakage flux is generated over the parallel-connected remaining cross section. Through respective dimensioning of the permanent magnet, it is now possible in a simple manner to conduct the flux of the permanent magnet primarily via the series connection of core/yoke and the armature when the armature is closed, to generate a high retention force upon the armature. When the armature is released, i.e. open, at formation of a great useful air gap, the permanent magnet generates a magnetic flux which primarily effects in the region at hand the above-mentioned leakage flux with increased magnetic resistance, to thereby keep the magnetic force in the air gap small. Thus, comparably weak springs can be utilized to retain the armature in the released position so long as the return force of the spring exceeds the magnetic forces exerted by the permanent magnet acting upon the released armature.

Suitably, the remaining part of the cross sectional area in the region accommodating the permanent magnet is constituted by an air gap so that the switching arrangement can easily and inexpensively be made because the magnetic circuit requires only the incorporation of only one permanent magnet in the cross sectional area of the core or yoke so long as part of this cross section is formed by an air gap.

The air gap and the permanent magnet can be disposed relative to each other in various fashion. Preferably, the air gap surrounds the permanent magnet in a ring-shaped manner. This particular simple geometric relationship results in an easy and inexpensive production of the switching arrangement and in a symmetric distribution of the leakage flux so that irregular field patterns within the yoke are eliminated.

Suitably, the ring-shaped air gap has a thickness of stepped configuration in order to enable a variation of the magnetic resistance in dependence on the graduation of the gap thickness.

It is however also possible to have the permanent magnet form a full cross section so that commercially available configurations of permanent magnets can be utilized to make the switching arrangement according to the invention, or to form the air gap in a cavity within the permanent magnet. This ensures a leakage flux when the armature is released, whereby the leakage flux is generated by the air gap in the cavity of the permanent magnet.

In accordance with another embodiment of the present invention, the permanent magnet may be dimensioned such that its circumference is congruent to the circumference of the cross section of the magnetic circuit, e.g. of the yoke, and surrounds a constriction of the magnet circuit, e.g. of the yoke. The constriction of the magnetic circuit results in a saturation of the material of the magnetic circuit. The saturation of the material creates an effect that is identical to the effect of a leakage flux.

According to another feature of the present invention, the permanent magnet may be positioned between the pole face of the yoke and a pole flange, with bead-like projections of the pole flange extending laterally of the permanent magnet at a distance thereto to define an air gap therebetween. At their crests, the projections bear upon the pole face of the yoke. This configuration results in a constriction of the magnetic circuit so that the area about the bead-like projections become magnetically saturated when the armature is released. In addition, a leakage flux is created in the remaining air gap so that the combination of constriction and air gap closes the field lines of the permanent magnet.

It is also possible to arrange the permanent magnet between the pole face of the yoke and the pole flange in such a manner that an annular elevation of the pole flange surrounds the permanent magnet at formation of a ring-shaped air gap and bears with its end face upon the pole face of the yoke. Also in this case, the combination of a ring-shaped air gap and a constriction of the magnetic circuit prevents a shorting of the permanent magnet, on the one hand, and a closing of the field lines of the permanent magnet when the armature is released, on the other hand.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
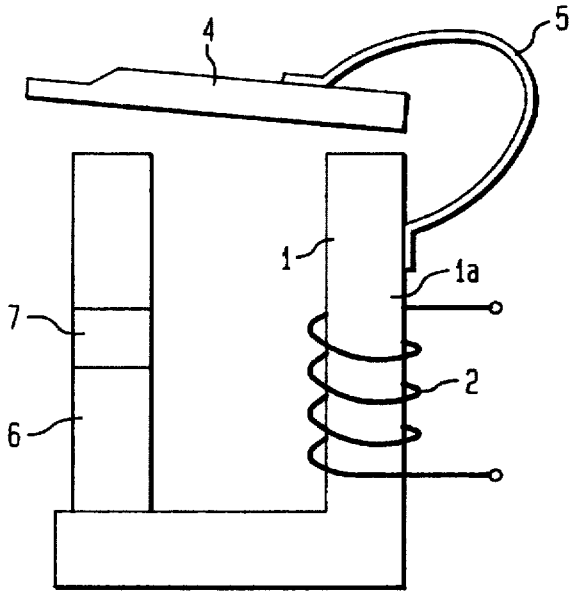
FIG. 1 (PRIOR ART)
FIG. 1 is a schematic illustration of a conventional switching arrangement.

Throughout all the Figures, the same or corresponding elements are generally indicated by the same reference numerals.

Turning now to the drawing, and in particular to FIG. 1, there is shown a schematic illustration of a conventional switching arrangement in form of a magnetic system including a generally U-shaped core structure comprised of a L-shaped core 1 having one shank or bar section 1*a* onto which a coil 2 is wound another bar section forming a yoke 6 placed vertically on the core in substantially parallel disposition of the bar section 1*a*, and an armature 4 which is swingably mounted to the core 1 via a spring 5. Incorporated at a suitable location in the yoke 6 is a permanent magnet 7. Certainly, more such permanent magnets may be utilized and incorporated in the magnetic circuit, be it in the yoke 6 or also in the core 1 and/or in the armature 4. Also, the permanent magnet 7 may itself be composed of several permanent magnets.

The magnetic flux generated by the permanent magnet 7 may be strengthened or weakened by the coil 2 in dependence on the polarity of the applied voltage. To maintain two stable states, the spring 5 retains the armature 4 in the open position in opposition to the attractive force of the permanent magnet 7. Only when the coil 2 is energized by an operating voltage in order to increase the magnetic flux of the permanent magnet 7, can the armature 4 overcome the force exerted by the spring 5 and move into the other stable state, with the permanent magnet 7 holding the armature 4 in position. In order to move the armature 4 into the open position, the opposite operating voltage must be applied to energize the coil 2 so as to weaken the magnetic flux of the permanent magnet 7 to such a degree that the armature 4 is released.

Figure 2:
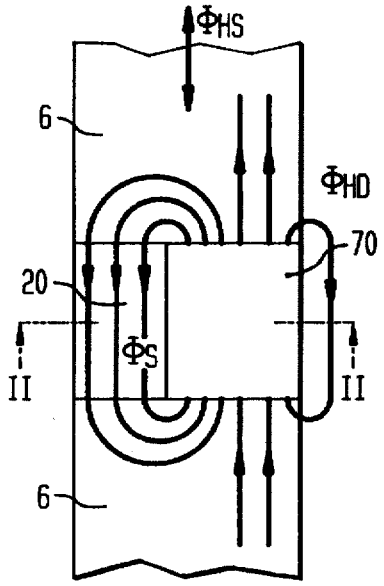
FIG. 2 is a fragmentary, schematic illustration of a first embodiment of a switching arrangement according to the present invention.
Figure 2A:
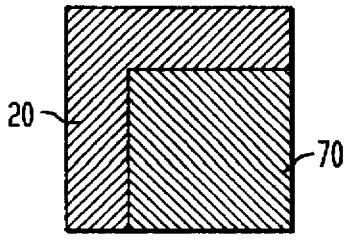
FIG. 2*a* is a sectional view of the switching arrangement taken along the line II—II in FIG. 2.

Turning now to FIG. 2, there is shown a fragmentary, schematic illustration of a first embodiment of a switching arrangement according to the present invention, showing in detail a section of the yoke 6 which accommodates at a suitable location a permanent magnet 70 in such a manner that the permanent magnet 70 extends only partially across the cross sectional area of the yoke 6. The remaining area of the cross section is formed by a non-magnetic or non-magnetizable material, e.g. plastic or a medium such as air, indicated by reference numeral 20 and shown more clearly in FIG. 2*a*.

Persons skilled in the art will understand that even though FIG. 2 shows only the incorporation of one permanent magnet in a cross sectional area of a respective region of the yoke 6, it is certainly within the scope of the present invention to position one or more permanent magnets of this type across different cross sectional areas of the yoke 6.

The provision of the non-magnetic member 20 in the cross sectional area next to the permanent magnet 70 closes at opened armature 4 the magnetic circuit with the leakage flux $\phi_S$ so that part of the magnetic flux $\phi_{HD}$ emanating from the permanent magnet 70 flows via the non-magnetic member 20 and thereby fails to add to the attractive force upon the armature 4. Thus, the spring 5 for retaining the armature 4 can be of comparably weaker configuration, and the required energy for suitably energizing to the coil 2 to move the armature 4 between the stable positions can be lowered. The magnetic flux generated by the coil 2 is designated with $\phi_{Hr}$.

It will be understood by persons skilled in the art that the regions with permanent magnets 70 and increased magnetic resistance can be positioned at any suitable location within the magnetic circuit.

Figure 3:
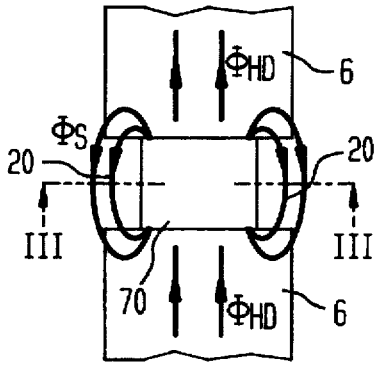
FIG. 3 is a fragmentary, schematic illustration of a second embodiment of a switching arrangement according to the present invention.
Figure 3A:
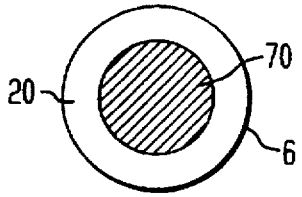
FIG. 3*a* is a sectional view of the switching arrangement taken along the line III—III in FIG. 3.

In the embodiment according to FIG. 3, the permanent magnet 70 is substantially centrally positioned in the cross sectional area of the yoke 6 and is surrounded by the non-magnetic member 20 which forms an annular space, as shown in FIG. 3*a*. The non-magnetic member 20 may be formed e.g. by air. The permanent magnet 70 may be formed as solid section that is smaller than the cross section of the yoke 6. The leakage flux $\phi_S$ generated at released armature 4 extends in this ring-shaped gap and thus weakens the attractive force of the permanent magnet 70 upon the released armature 4.

Figure 4:
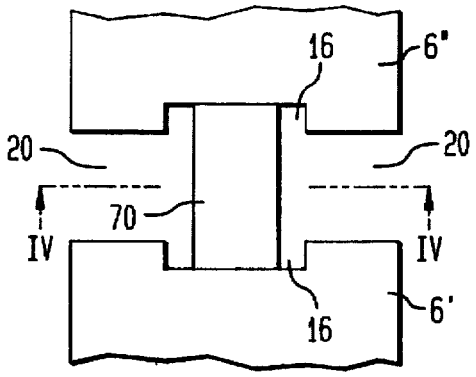
FIG. 4 is a fragmentary, schematic illustration of a third embodiment of a switching arrangement according to the present invention.
Figure 4A:
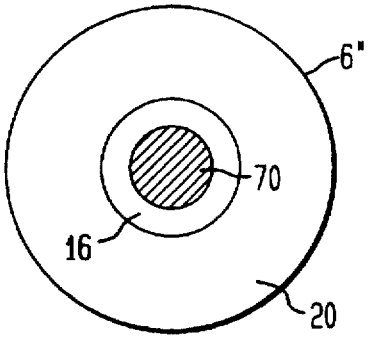
FIG. 4*a* is a sectional view of the switching arrangement taken along the line IV—IV in FIG. 4.

FIG. 4 shows a variation of the switching arrangement according to FIG. 3. The yoke 6 is split in two yoke elements 6', 6", with the opposing end faces of the yoke elements 6', 6" being of U-shaped configuration to form a respective central depression 16. Extending between the depressions 16 is the permanent magnet 70 which has a diameter that is smaller than the diameter of the depression 16, as shown in FIG. 4*a*, and a height that exceeds the sum of the depths of both depressions 16. The permanent magnet 70 is thus surrounded by an annular space 20, e.g. in form an air gap, the width or thickness of which is of stepped configuration, and a magnetic shorting at the edge of the permanent magnet 70 is eliminated. The size of the graduation formed by the depressions 16 allows a dimensioning of the leakage flux $\phi_S$.

It will be understood by persons skilled in the art that it is certainly possible to provide one of the yoke elements 6', 6" with a flat end face and the other one of the yoke elements 6', 6" with a depression 16 of correspondingly greater depth.

Figure 5:
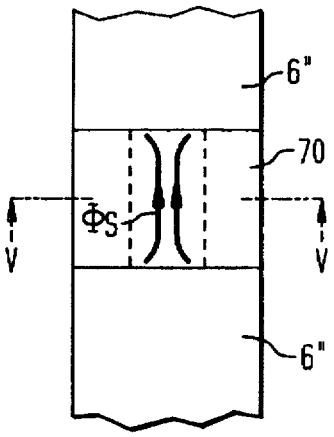
FIG. 5 a fragmentary, schematic illustration of a fourth embodiment of a switching arrangement according to the present invention.
Figure 5A:
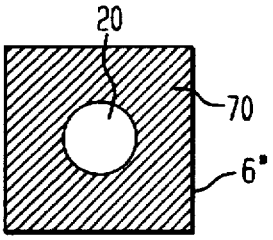
FIG. 5*a* is a sectional view of the switching arrangement taken along the line V—V in FIG. 5.

In the embodiment according to FIG. 5, the permanent magnet 70 is set in the cross sectional area such that its outer circumference is flush with the outside perimeter of the yoke elements 6', 6". Centrally within, the permanent magnet 70 has a cavity 18 for receiving the non-magnetic member 20 (FIG. 5*a*) so that a leakage flux $\phi_S$ is created in the area of the cavity 18 of the permanent magnet 70 when the armature 4 is released. The cavity 18 axially traverses the permanent magnet 70 and can be of random configuration. It will be appreciated that the central location of the cavity 18 is shown only by way of example and may certainly be positioned differently.

Figure 6:
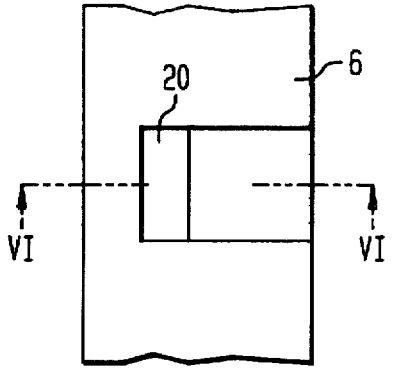
FIG. 6 is a fragmentary, schematic illustration of a fifth embodiment of a switching arrangement according to the present invention.
Figure 6A:
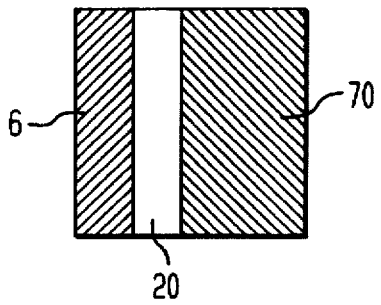
FIG. 6*a* is a sectional view of the switching arrangement taken along the line VI—VI in FIG. 6.

FIG. 6 shows an embodiment of a switching arrangement according to the present invention in which one cross sectional area of the magnetic circuit, here e.g. the yoke 6, is formed, in neighboring relationship, partly by the permanent magnet 70, partly by the non-magnetic member 20, e.g. an air gap, and partly bythe material of the yoke 6.

Figure 7:
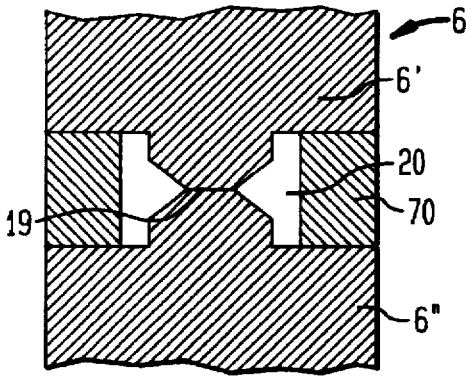
FIG. 7 is a schematic, sectional view of a sixth embodiment of a switching arrangement according to the present invention.

FIG. 7 shows a longitudinal section of another embodiment of a switching arrangement according to the present invention in which the permanent magnet 70 is of doughnut shape with a central opening and has a circumference which is congruent to the circumference of the cross section of the magnetic circuit, (here the yoke 6). Projecting axially from each end face of the yoke elements 6', 6" into the opening of the permanent magnet 70 is a central projection 19 in form of a truncated cone to form in the cross sectional area a constriction which is surrounded by the permanent magnet 70. The apex of the opposing projections 19 abut each other. The non-magnetic member 20 in the cross sectional area is formed as air gap and is defined between the inside wall surfaces of the permanent magnet 70 and of both projections 19 of the yoke elements 6', 6". Again, the non-magnetic element 20 prevents a magnetic shorting of the permanent magnet 70.

Persons skilled in the art will understand that the projections 19 need not necessarily be configured in the shape of a truncated cone, but may be formed in any suitable cross section by which a constriction is created. Also in this embodiment, the zone of the projections 19 is magnetically saturated when the armature 4 is released so that the field lines of the permanent magnet 70 partially traverse therethrough, without causing a magnetic shorting.

Figure 8:
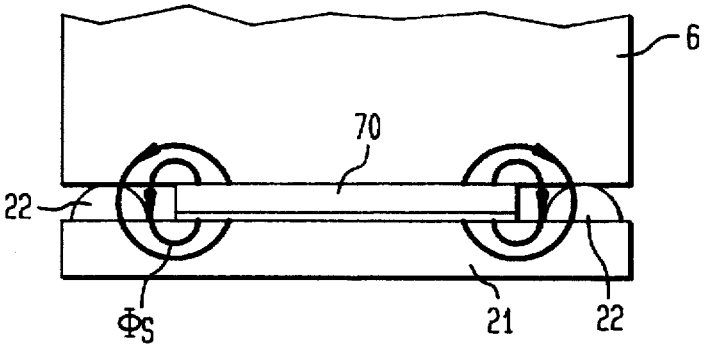
FIG. 8 is a schematic illustration of a seventh embodiment of a switching arrangement according to the present invention.
Figure 8A:
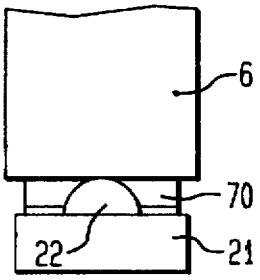
FIG. 8*a* is a front view of a switching arrangement shown in FIG. 8.
Figure 10:
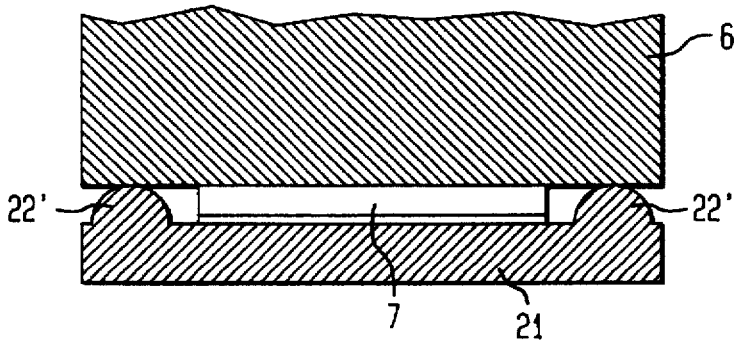
FIG. 10 is a sectional view of a modification of the switching arrangement of FIG. 8.

Turning now to FIGS. 8 and 8*a*, there are shown detailed illustrations of the area of a pole face of the yoke 6. A flat permanent magnet 70 is positioned at the pole face of the yoke 6 in such a manner that only part of the cross sectional area of the yoke 6 is occupied. Placed upon the permanent magnet 70 is a pole flange 21 which is provided with bead-like projections 22 extending into the free zone of the cross sectional area and having a same height as the permanent magnet 70. The projections 22 are positioned on each side of the permanent magnet 70, with their apex bearing upon the pole face of the yoke 6 so that an air gap is defined between the projections 22 and the permanent magnet 70. Persons skilled in the art will understand that the bead-like projections 22 can certainly be substituted by a ring-shaped elevation 22' which surrounds the permanent magnet 70 and bears with its apex upon the pole flange of the yoke 6, to thereby form a ring-shaped air gap between the permanent magnet 70 and the ring-shaped elevation 22", is shown in FIG. 10.

In the released state of the armature 4, a leakage field $\phi_S$ is generated and the zone around the bead-like projections 22 or the ring-shaped elevation 22' becomes magnetically saturated so that the field lines of the permanent magnet 70 are closed without causing a magnetic shorting.

Figure 9:
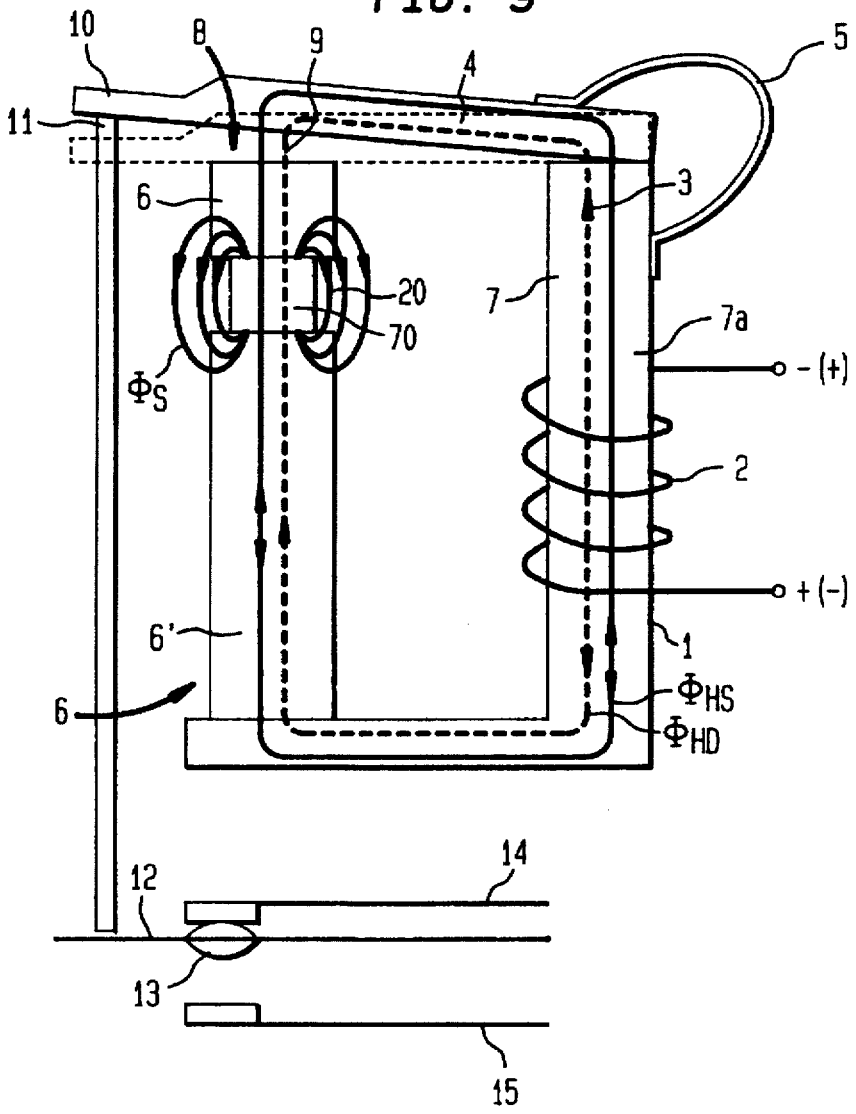
FIG. 9 is a exemplified schematic illustration of a switching arrangement according to the present invention for operating a contact.

FIG. 9 illustrates an exemplified application of a switching arrangement according to the present invention for actuation of a movable contact 12. The non-magnetic or non-magnetizable member 20 in the cross sectional area at one region of the magnetic circuit is formed by an air gap. This bistable switching arrangement includes a L-shaped core 1 with a magnetic core 2 being wound on the vertical shank of the core 1. Placed upon one pole face 3 of the core 1 is the armature 4 which is pivotally held by means of the spring 5 upon the core 1. The spring 5 generates a respective return force in order to maintain the armature 4 in the illustrated released position in opposition to the attractive force created by the permanent magnet 70.

The yoke 6 which is connected to the horizontal shank of the core 1 is of split configuration to define two yoke elements 6, 6" which are joined together by the permanent magnet 70 that has a smaller cross section than the yoke 6 so that a leakage flux $\phi_S$ is generated in the areas of the yoke elements 6', 6" adjacent the permanent magnet 70 when the armature 4 is released. Thus, smaller attractive forces are exerted upon the armature 4 when retained in the open position.

The pole face 8 of the yoke 6 coacts with the armature 4 and defines a useful air gap 9. Furthermore, the armature 4 is provided with a prolongation 10 which controls a comb 11. Engaging the comb 11 is the movable contact 12 which is provided with two contact beads 13 and coacts with two fixed contacts 14, 15.

The main flux $\phi_{HS}$ generated by the energized magnetic coil 2 strengthens or weakens the magnetic flux $\phi_{HD}$ of the permanent magnet 70 which is magnetized in axial direction of the yoke 6 in dependence on the polarity of the applied voltage of the magnetic coil 2.

While the invention has been illustrated and described as embodied in a bistable switching arrangement, it is not intended to be limited to the details shown since various modifications and structural changes may be made without departing in any way from the spirit of the present invention.

What is claimed as new and desired to be protected by Letters Patent is set forth in the appended claims:

We claim:

1. A bistable electric switching arrangement, comprising:

a magnetic system including a core structure having one bar section carrying a coil and another bar section, and a spring-biased armature swingably mounted to the one bar section of the core structure for movement between two stable switching states;

at least one permanent magnet being so positioned in at least one region other bar section as to form only part of a cross sectional area of said region; and a pole flange, said permanent magnet being positioned between the pole flange and a pole face of the other bar section, said pole flange including bead-like projections laterally of the permanent magnet and spaced by an air gap, said projections having an apex bearing upon the pole face of the other bar section.

2. The bistable switching arrangement of claim 1 wherein another part of the cross sectional area is formed by a non-magnetic member.

3. The bistable switching arrangement of claim 2 wherein the non-magnetic member is formed by an air gap in an area of the region adjacent the permanent magnet.

4. The bistable switching arrangement of claim 3 wherein the air gap is formed around the permanent magnet in a ring-shaped manner.

5. The bistable switching arrangement of claim 4 wherein the ring-shaped air gap has a graduated thickness.

6. The bistable switching arrangement of claim 3 wherein the air gap is formed in a cavity within the permanent magnet.

7. A bistable electric switching arrangement, comprising:

a magnetic system including a U-shaped core structure having one bar section carrying a coil and another bar section, and a spring-biased armature swingably mounted to the one bar section of the core structure for movement between two stable switching states; and at least one permanent magnet being so positioned in at least one region of the other bar section as to form only pad of a cross sectional area of said region, wherein the permanent magnet has a ring-shaped configuration and is so received in the region as to be flush with an outside surface of the other bar section, said other bar section being formed in the region with a constriction which is surrounded by the permanent magnet at a distance thereto.

8. A bistable electric switching arrangement, comprising:

a magnetic system including a U-shaped core structure having one bar section carrying a coil and another bar section, and a spring-biased armature swingably mounted to the one bar section of the core structure for movement between two stable switching states; and at least one permanent magnet being so positioned in at least one region of the other bar section as to form only part of a cross sectional area of said region;

a pole flange, said permanent magnet being positioned between the pole flange and a pole face of the other bar section, said pole flange having an annular elevation surrounding the permanent magnet at formation of a ring-shaped air gap and having one end face bearing upon the pole face of the other bar section.

* * * * *

UNITED STATES PATENT AND TRADEMARK OFFICE

CERTIFICATE OF CORRECTION

PATENT NO. : 5,703,554

DATED : December 30, 1997

INVENTOR(S) : Tibor Polgar & Rudolf Mikl

It is certified that error appears in the above-identified patent and that said Letters Patent is hereby corrected as shown below:

Column 3, line 61, add --1-- after "core",
Column 6, line 8, change "is" to --as--,
Column 6, line 64, add --of the-- after "one region".

Signed and Sealed this

Twenty-sixth Day of May, 1998

*Attest:*

Bruce Lehman

BRUCE LEHMAN

*Attesting Officer*

*Commissioner of Patents and Trademarks*